US010829834B2

(12) United States Patent
Weimer et al.

(10) Patent No.: US 10,829,834 B2
(45) Date of Patent: Nov. 10, 2020

(54) APPARATUS AND METHOD FOR RECOVERY OF MATERIAL

(71) Applicant: The Regents of the University of Colorado, a body corporate, Denver, CO (US)

(72) Inventors: Alan W. Weimer, Niwot, CO (US); Aaron W. Palumbo, Denver, CO (US); Illias Hischier, Boulder, CO (US); Arto J. Groehn, Boulder, CO (US); Boris A. Chubukov, Boulder, CO (US); Scott C. Rowe, Boulder, CO (US); Richard Fisher, Broomfield, CO (US)

(73) Assignee: THE REGENTS OF THE UNIVERSITY OF COLORADO A Body Corporate, Denver, CO (US)

( * ) Notice: Subject to any disclaimer, the term of this patent is extended or adjusted under 35 U.S.C. 154(b) by 287 days.

(21) Appl. No.: 15/741,159

(22) PCT Filed: Mar. 4, 2016

(86) PCT No.: PCT/US2016/021044

§ 371 (c)(1),
(2) Date: Dec. 29, 2017

(87) PCT Pub. No.: WO2017/003528

PCT Pub. Date: Jan. 5, 2017

(65) Prior Publication Data

US 2018/0195148 A1 Jul. 12, 2018

Related U.S. Application Data

(60) Provisional application No. 62/187,728, filed on Jul. 1, 2015.

(51) Int. Cl.

| | |
|---|---|
| ***C22B 5/10*** | (2006.01) |
| ***C22B 5/16*** | (2006.01) |
| ***C22B 9/04*** | (2006.01) |
| *C22B 21/02* | (2006.01) |
| *C22B 26/22* | (2006.01) |

(52) U.S. Cl.
CPC ..... *C22B 5/10* (2013.01); *C22B 5/16* (2013.01); *C22B 9/04* (2013.01); *C22B 21/02* (2013.01); *C22B 26/22* (2013.01)

(58) Field of Classification Search
CPC ..... C22B 26/22
See application file for complete search history.

(56) References Cited

U.S. PATENT DOCUMENTS 10,400,309 B2 * 9/2019 Weimer ..... C22B 1/14

FOREIGN PATENT DOCUMENTS

WO WO-2015031682 A1 * 3/2015 ..... C01B 21/0726

* cited by examiner

*Primary Examiner* — Scott R Kastler
(74) *Attorney, Agent, or Firm* — Holzer Patel Drennan

(57) ABSTRACT

Systems and methods for recovering material from a gas phase are provided. Exemplary systems include a moving bed of particles onto which material can be deposited. The systems can operate in a continuous or semi-continuous mode.

19 Claims, 2 Drawing Sheets

APPARATUS AND METHOD FOR RECOVERY OF MATERIAL

CROSS REFERENCE TO RELATED APPLICATIONS

This application is a U.S. national stage entry under 35 U.S.C. § 371 of International Application No. PCT/US2016/021044 entitled APPARATUS AND METHOD FOR RECOVERY OF MATERIAL, filed Mar. 4, 2016, which claims the benefit of U.S. Provisional Patent Application Ser. No. 62/187,728, entitled APPARATUS AND METHOD FOR CONTINUOUS RECOVERY OF METALLIC VAPORS, and filed Jul. 1, 2015, the disclosures of which are incorporated herein by reference to the extent such disclosures do not conflict with the present disclosure.

STATEMENT REGARDING FEDERALLY SPONSORED RESEARCH OR DEVELOPMENT

This invention was made with government support under grant number DE-AR0000404 awarded by the U.S. Department of Energy. The U.S. government has certain rights in the invention.

FIELD OF DISCLOSURE

The present disclosure generally relates to systems and methods for recovering material from a gas phase. More particularly, the disclosure relates to systems for recovering materials, such as metals, and to methods of using and forming the systems.

BACKGROUND

Condensers or systems can be used for a variety of applications to recover desired material that is initially in a gas state or phase by condensing the material to a liquid or depositing material as a solid. For example, condensers or systems can be used to recover desired metal(s) in a vapor/gas phase into a liquid or solid state.

Exemplary systems suitable for condensing or depositing metal from the gas phase include a vessel and material onto which the metal can condense or be deposited. Such systems are typically not configured to run in a continuous or semi-continuous mode. As a result, recovery of material from such systems can require a significant amount of process time and cost.

Material recovery yields of such systems can also be relatively low. As a result, relatively high operating costs and capital costs can be required to recover the desired materials. Moreover, oxidation of desired material during the recovery process (condensation or deposition/antisublimation/desublimation) can occur, further limiting overall material recovery and material quality obtained using such systems. Accordingly, improved systems and methods for recovering material are desired.

SUMMARY

The present disclosure generally relates to systems and methods for recovering one or more materials, such as one or more metals, that are initially in a gas phase. More particularly, various examples of the disclosure relate to systems and methods that can operate in a continuous or semi-continuous mode of operation. Additionally or alternatively, exemplary systems, and methods employ a moving bed of particles onto which material can be deposited (which can include antisublimation, which is also known as desublimation) and/or maintain reactive gas partial pressures at relatively low values to mitigate unwanted reactions (e.g., oxidation). While the ways in which the systems and methods address various drawbacks of prior systems and methods are discussed in greater detail below, in general, exemplary systems allow for relatively cost-effective and/or time-efficient means for recovery of desired material(s), such as one or more metals.

In accordance with exemplary embodiments of the disclosure, a recovery system includes a housing that includes a first inlet to receive a supply of moving bed of particles flowing in a first direction through the housing, a second inlet for receiving gas-phase material comprising a material to be recovered, a deposition region, and one or more outlets. The recovery system can include additional inlets to receive, for example, one or more diluents, additional moving bed particles, or the like. In accordance with various aspects of these embodiments, the recovery system operates in a continuous or semi-continuous mode, such that material is continuously or semi-continuously provided to and removed from the recovery system. In accordance with further aspects, the recovery system operates at a reduced pressure—e.g., sub-atmospheric pressure. In accordance with further examples of these embodiments, a partial pressure of any reactive gas (e.g., gas that can react with material to be recovered or recovered material) has a partial pressure in the housing (e.g., within the deposition region of the housing), below about 50,000 pascals (Pa), about 10,000 Pa, or about 500 Pa, or is between about 100 Pa and about 50,000 Pa, between about 250 Pa and about 25,000 Pa, or between about 500 Pa and 5,000 Pa. The particles of the moving bed can flow in a first direction and the gas-phase material can flow in a second direction within the deposition region. The first and second directions can be in the same direction (co-current flow), in opposite directions (counter-current flow), in an orthogonal direction (cross-current flow), in other suitable direction(s), and combinations thereof. In accordance with yet further aspects of these embodiments, a supersaturation ratio of the material to be recovered (ratio of the vapor pressure of the material to be recovered to the equilibrium vapor pressure of the material to be recovered) within the deposition region is greater than 1 and less than 10,000, greater than 1 and less than 5,000, greater than 1 and less than 500, greater than 1 to about 50, greater than 1 to about 10, or greater than 1 to about 5. The temperature of the moving bed particles within the deposition region is desirably kept relatively near and below the melting point of the material to be deposited.

In accordance with additional exemplary embodiments of the disclosure, a system includes a recovery system, such as a recovery system described herein. The system can include one or more of each of a vacuum source, a feed hopper, a heat source, a cooling source, and a reactor coupled to the recovery system. The reactor can produce a gas stream including one or more materials to be recovered, such as gas produced from heating (e.g., carbothermal reduction) of metal oxides or the like.

In accordance with further exemplary embodiments of the disclosure, a method of recovering material from a gas phase includes the steps of: providing a recovery system, such as a recovery system described herein, providing a gas comprising material to be recovered, such as from a reactor, providing a moving bed of particles onto which the material to be recovered is deposited, and removing recovered material from the recovery system. The method can operate in a continuous or semi-continuous mode. The gas comprising material to be recovered and the moving bed of particles can respectively flow in co-current, counter-current, cross-current, other relational direction, and combinations thereof. During recovery of the material to be deposited, a partial pressure of any reactive gas, such as an oxidizing gas, can be below about 50,000 Pa, about 10,000 Pa, or about 500 Pa, or is between about 100 Pa and about 50,000 Pa, between about 250 Pa and about 25,000 Pa, or between about 500 Pa and about 5000 Pa. A supersaturation ratio of the material to be recovered can be greater than 1 and less than 10,000, greater than 1 and less than 5,000, greater than 1 and less than 1,000, greater than 1 and less than 500, greater than 1 to about 50, greater than 1 to about 10, or greater than 1 to about 5. A temperature of the moving bed particles within a deposition region can be kept near and below the melting point of the material to be deposited.

BRIEF DESCRIPTION OF THE DRAWING FIGURES

These and other features, aspects, and advantages of the invention disclosed herein are described below with reference to the drawings of certain embodiments, which are intended to illustrate and not to limit the invention.

It will be appreciated that the figures are not necessarily drawn to scale. For example, the dimensions of some of the elements in the figures may be exaggerated relative to other elements to help to improve understanding of illustrated embodiments of the present disclosure.

DETAILED DESCRIPTION OF EMBODIMENTS OF THE DISCLOSURE

The description of exemplary embodiments of the present invention provided below is merely exemplary and is intended for purposes of illustration only; the following description is not intended to limit the scope of the invention disclosed herein. Moreover, recitation of multiple embodiments having stated features is not intended to exclude other embodiments having additional features or other embodiments incorporating different combinations of the stated features.

Exemplary reactors, systems, components thereof, and methods are described below. The reactors, systems, and methods can be used for a variety of applications where recovery of material by deposition that includes desublimation of the material from a gas phase to a liquid or solid phase is desired. As used herein, deposition means physical deposition due to desublimation, as opposed to chemical or other physical deposition. Particular examples of the disclosure are discussed below in connection with recovery of metal(s) from a gas phase, such as a gas-phase product of a carbothermal reduction reactor system. Exemplary carbothermal reactor systems are described in PCT Application No. PCT/US14/53273, filed Aug. 28, 2014, and entitled CARBOTHERMAL REDUCTION REACTOR SYSTEM, COMPONENTS THEREOF, AND METHODS OF USING SAME, the contents of which are hereby incorporated herein by reference, to the extent such contents do not conflict with the present disclosure.

Figure 1:
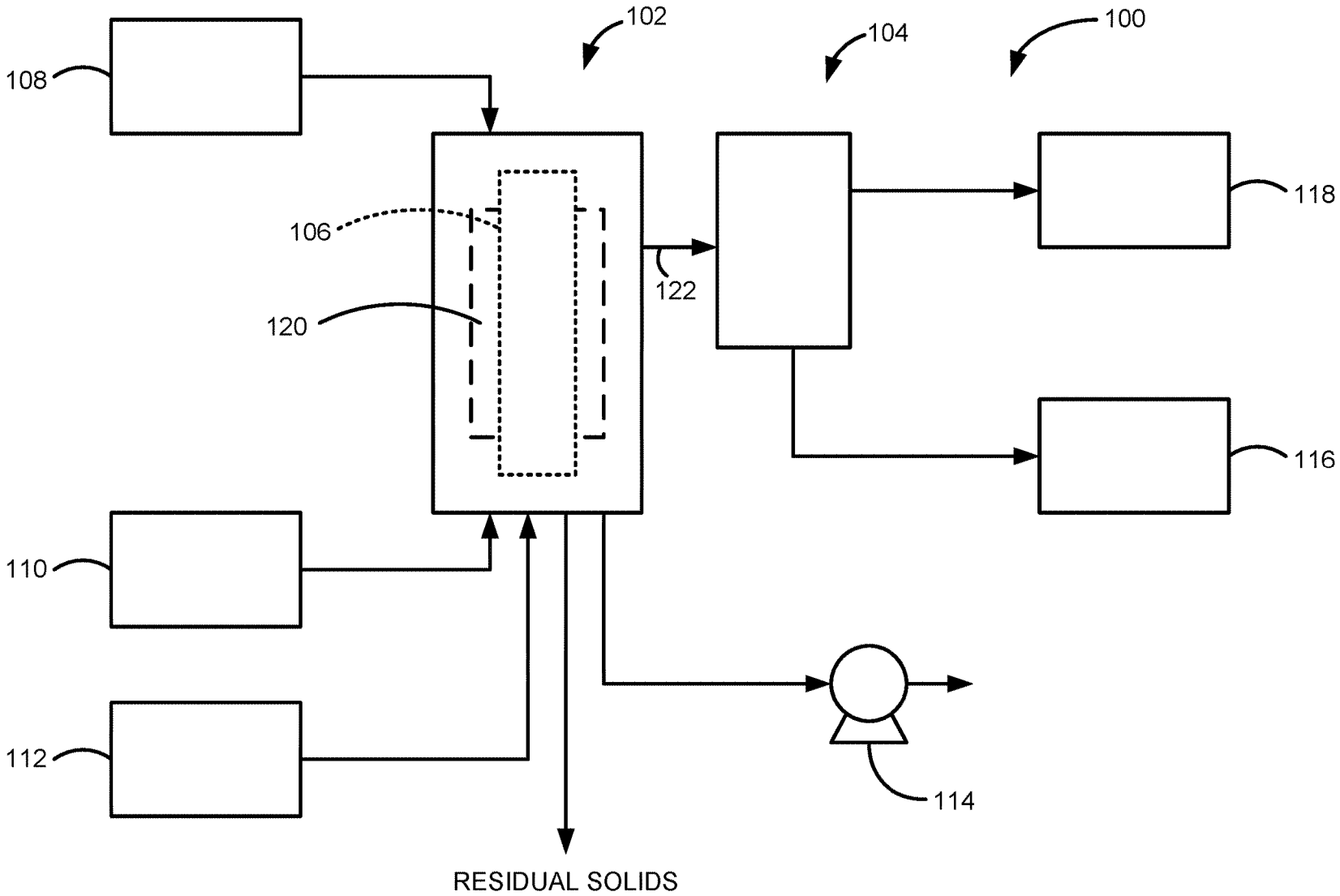
FIG. 1 illustrates a system in accordance with at least one embodiment of the disclosure.

FIG. 1 illustrates a system 100 in accordance with exemplary embodiments of the disclosure. System 100 includes a reactor system 102 and a recovery system 104.

Reactor system 102 includes a reaction vessel 106 (e.g., a reaction tube), heaters 120 around reaction vessel 106, a feed (e.g., pellet) source 108, an optional reactant gas source 110, an optional inert gas source 112, and a vacuum source 114. System 100 can also include a purification apparatus 116, and/or a heat generation/recuperation apparatus 118. Exemplary systems can include any suitable number of reactor systems 102, recovery systems 104, pellet sources 108, reactant gas sources 110, inert gas sources 112, vacuum sources 114, purification apparatus 116, heat generation/recuperation apparatus 118, and heaters 120.

During operation of system 100, feed (e.g., pellets) from source 108 undergoes a carbothermal reduction process to reduce material within the pellets. One or more heaters 120 can provide heat to facilitate the reaction. System 100 can be used to, for example, reduce metal oxides to metal and/or to produce ceramic materials, such as silicon carbide, tungsten carbide and boron carbide. Further yet, the combined reduction with carbon and nitridation with nitrogen or ammonia can be used to produce nitride non-oxide ceramics such as aluminum nitride and silicon nitride from metal oxide material contained in the pellets. A product gas stream 122, including metal, is sent to recovery system 104 for recovery of the metal from the gas stream. A more detailed description of exemplary carbothermal reduction reactor systems is provided in PCT Application No. PCT/US14/53273.

Figure 2:
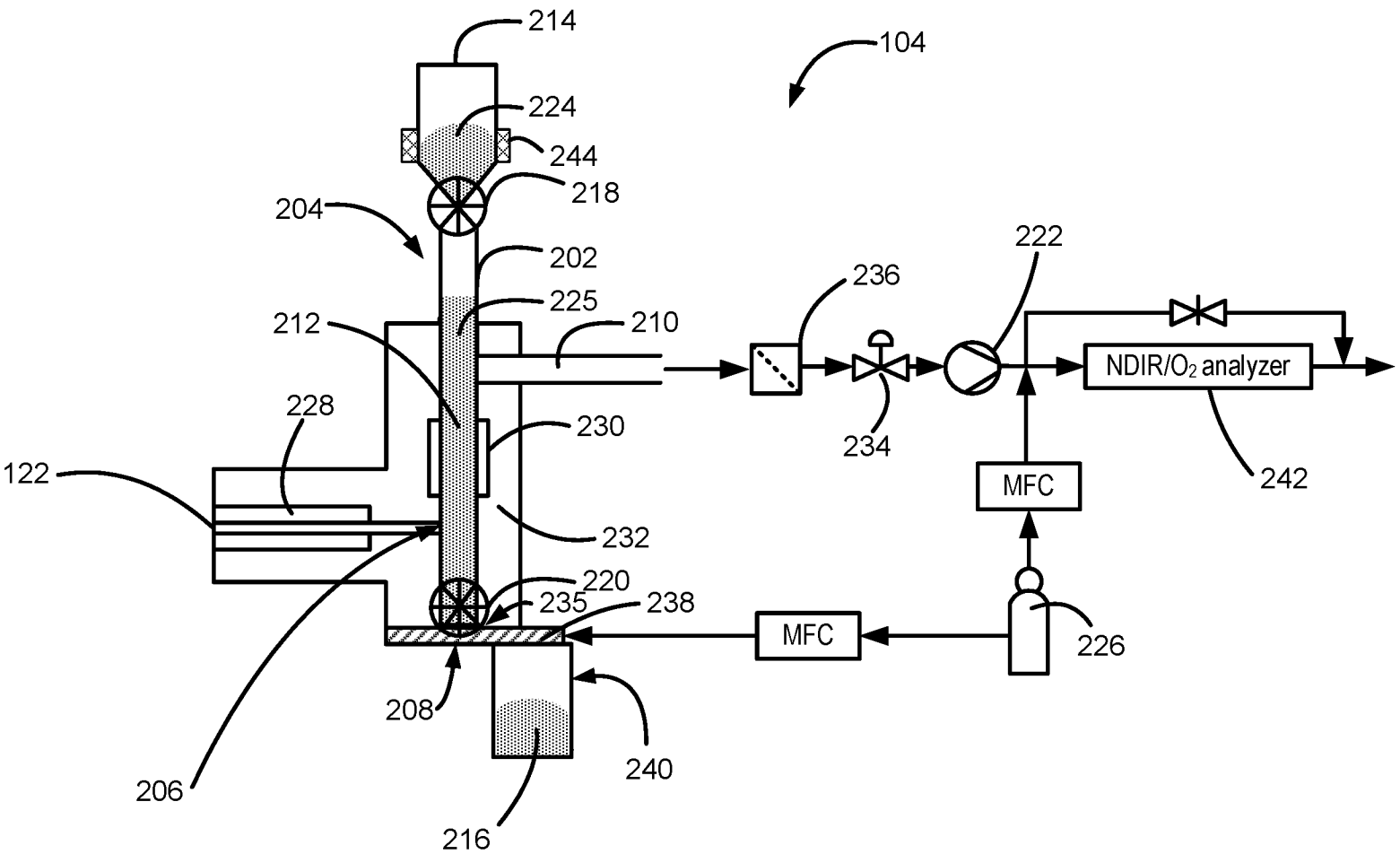
FIG. 2 illustrates a recovery system in accordance with at least one embodiment of the disclosure.

FIG. 2 illustrates an exemplary recovery system 104 in greater detail. Recovery system 104 includes a housing or vessel 202 in which deposition (e.g., desublimation) of material occurs. Housing 202 includes a first inlet 204 for receiving a supply of moving bed particles 225, a second inlet 206 for receiving gas-phase material including material to be recovered—e.g., stream 122 from reactor system 102, a first outlet 208 to collect recovered/deposited material, a second outlet 210 for byproducts and/or other gases, and a deposition region 212 within housing 202 and between first inlet 204 and first outlet 208. Recovery system 104 also includes a feed source (e.g., a hopper) 214, a collection vessel 216, and valves 218, 220, respectively, between feed source 214 and housing 202, and between housing 202 and collection vessel 216. Valves 218, 220 can include star valves or other suitable valves to enable reduced pressure operation and continuous or semi-continuous addition/removal of solids to housing 202. Recovery system 104 can also include a vacuum source 222, which can be the same as or different from vacuum source 114. Recovery system 104 can also include heaters 228, 230 and/or cooling jackets (not illustrated) to control a temperature of inlet stream 112 and/or deposition region 212. Recovery system 104 can also include one or more gas sources 226, such as dilute CO in an inert gas, or inert gas(es) such as nitrogen or argon. Gas from source 226 and/or recycled gas from outlet 210 can be added to housing 202 (e.g., deposition region 212 within housing 202) to prevent oxygen from leaking into recovery system 104. Such gases can be heated (e.g., to an operating temperature or near an operating temperature of recovery system 104).

Housing 202 can include a tube—e.g., a tube having a length of about four feet an inside diameter of about 1.8 inches, and an outside diameter of about two inches. Housing 202 can be formed of, for example, stainless steel, aluminum oxide, or other suitable material. Although not illustrated, recovery system 104 can include thermocouples (e.g., K-type and/or C-type) and/or pressure gauges to measure temperatures and/or pressures within or outside of housing 202.

Housing 202 can be at least partially surrounded by insulating material 232. Insulating material 232 can be formed of or include, for example, alumina insulation.

Feed source 214 can operate under a vacuum. For example, feed source 214 can have an operating pressure at or near an operating pressure of housing 202. Feed source 224 can include a load lock to allow continuous operation of recovery system 104. Heaters or heat source 244 can be used to heat particles 224 prior to particles 224 entering housing 202.

Collection vessel 216 can include any suitable container. Collection vessel 216 can be under vacuum pressure during operation of recovery system 104. Collection vessel 216 can additionally or alternatively be cooled and/or insulated.

Recovery system 104 can be used to recover a variety of materials, such as metals or materials including one or more metals. By way of examples, recovery system 104 can be used to recover one or more of volatile Zn, Mg, Mn, Sn, Al, Ca, Sb, Na, Bi, Be, Ti, Hf, Zr, Si, and Ge from a gas. As set forth in more detail below, recovery system 104 can operate in a continuous or semi-continuous mode, mitigate unwanted reactions, such as oxidation of deposited or depositing material, and is scalable. And, recovery of material can be obtained without having to perform in-situ separation of deposited material from media 224 (particles of a moving bed of particles). However, such separation could be performed in-situ, if desired.

During operation of recovery system 104, particles/media 224 from feed source 214 are fed into first inlet 204 of housing 202. The particles (media) 224 can be fed into housing 202 as moving bed of particles 225. A desired temperature of moving bed of particles 225, discussed in more detail below, can be maintained by, for example, controlling an inlet temperature of particles 224, controlling a residence time of the particles, controlling a temperature of an incoming gas stream, such as stream 122, or the like. After material is deposited onto media 224, media with the deposited material thereon can, for example, be removed from deposition region 212 of housing 202 at a controlled rate (e.g., using auger or screw 238), such as a rate at which heat is added to the system via deposition and convection of hot gases and the ability of the system to absorb the added heat without adversely affecting the deposited material in terms of oxidation reactivity and/or rate of deposition. In accordance with exemplary embodiments of the disclosure, recovery system 104 includes a mechanism, such as auger or a screw feeder 238, and deposited material is collected by flowing media 224 in a moving bed configuration whose rate is controlled by, for example, gravity and the rotational rate of the auger or screw feeder 238 at the base of the media bed. Hot gas transfer is facilitated by active heating and insulation 232 in a transition zone 235 between deposition region 212 and a collection region 240.

Particles/media 224 can comprise, consist of, or consist essentially of desired material to be deposited. For example, if the desired material is or comprises magnesium (Mg), media 224 can comprise, consist of, or consist essentially of Mg. Media 224 can decrease the energy barrier of nucleation for material onto the particles or at least not increase the barrier for heterogeneous nucleation of the material. Media 224 can desirably have a mass that is sufficient to absorb the heat of deposition, while preventing formation of highly-reactive deposited material and/or preventing changes within the media 224 that negatively affect the deposition of the desired material. By way of example, when depositing magnesium on zirconia media, a mass flow ratio of zirconia to depositing magnesium is greater than or equal to 10:1. An average cross-sectional dimension of the initial feed particles/media 224 can depend on a scale of recovery system 104. Media diameter of cross-sectional lengths can be related to a diameter of housing 202. By way of examples, a ratio of housing diameter to cross-sectional length can range from about 3:1 to about 15:1, about 5:1 to about 15:1 or higher. In some examples, it is desirable to have deposited material having an average grain size of about 10 μm to about 100 μm or more to prevent or mitigate undesired oxidation of the deposited material. A critical size for a nucleus to be stable decreases with increasing supersaturation ratio. It is therefore desirable to run the deposition at low supersaturation levels (e.g., 1,000, 100, 10, 5 or less).

Media 224 can additionally or alternatively be composed of any sort of material that is generally considered to be inert to the system, does not easily attrit, and is readily flowable from an upstream hopper and through a removal device, such as an auger. Suitable materials for media 224 include pelletized carbon, alumina, stabilized magnesia, silica, magnesium, aluminum, and zirconia; this list is not exhaustive.

A gas stream (e.g., stream 122) including material to be deposited is fed into second inlet 206. Stream 122 can optionally be mixed with inert/diluent gases and/or recycled product gas from recovery system 104. Material (e.g., metal) is deposited onto particles 224. In addition to material to be deposited, the gas stream introduced at second inlet 206 can include byproduct gases (e.g., carbon monoxide, carbon dioxide, and the like in the case of a prior carbothermal reduction process or analogue chemistry, such as from reduction of magnesium oxide by calcium and/or ferrosilicon). The entrant gas can contain undesired gases that are condensable or able to undergo desublimation and therefore may be controlled to remain at temperatures that prevent or mitigate condensation or deposition of any such component, so as to not provide seed material for deposition of product(s) in a zone that is not at controlled conditions.

The flow directions of the entrant gases and media can facilitate the removal of deposited material from, in some cases, an oxidizing atmosphere, or an atmosphere comprised of, e.g., byproduct (e.g., carbothermic product gases), and can be designed to be co-current, counter-current, cross-current, other directions, or combinations of various directions. The flow directions of the entrant gas and media can be designed, such that temperature, and thus a supersaturation ratio (ratio of the vapor pressure of the material to be deposited to the equilibrium vapor pressure of the material to be deposited), is controlled along the flow direction of the gas flow, so as to create favorable deposition conditions for the duration of the residence time of the flowing gas within housing 202 and/or deposition region 212, since the partial pressure of depositing material is in flux as a direct result of material being deposited.

During deposition, a partial pressure of any reactive gas can be kept below a threshold in which oxidation or other undesirable reaction(s) can occur or are significant (e.g., react with more than 1 percent, 5 percent, or ten percent of the deposited or depositing material). By way of examples, a partial pressure of any reactive gas (e.g., oxygen-containing gas, such as carbon monoxide, carbon dioxide, and the like) can be kept below about 50,000 pascals ("Pa"), about 10,000 Pa, about 500 Pa, or other ranges noted herein. One way of obtaining the desired partial pressure of any reactive gas(es) is to maintain deposition region 212 at a suitable pressure. By way of examples, deposition region 212 or the interior of housing 202 can be maintained at a pressure of less than 100,000 Pa, or between about 100 Pa to about 100,000 Pa, about 400 to about 5,000 Pa, or other ranges noted herein. Vacuum source 222 and a valve 234 can be used to obtain the desired pressure within housing 202. Similarly, a residence time of byproduct gases can be controlled by controlling the pressure within housing 202. A pressure within housing 202 or throughout the entire system can be controlled through the use of valve 234 (e.g., a controllable throttle valve) whose inputs can include instantaneous absolute and differential pressure measurements at various points throughout system 100, recovery system 104, and/or housing 202.

It was previously thought that CO primarily (re-)oxidizes deposited metal and that rapid cooling, or quenching, was required to avoid re-oxidation. It has been surprisingly and unexpectedly discovered that the oxidizing potential of CO gas is minimal, or perhaps negligible, to the oxidizing potential of $CO_2$ gas which is known to be formed via Boudouard reaction, and especially in the presence of a metal catalyst, such as magnesium. Therefore, in accordance with examples of the disclosure, it is desirable to employ at least one means of reducing the partial pressure of CO gas in order to 1) reduce the rate of formation of $CO_2$ in the bulk gas phase and on the surface of deposited metal, and 2) to reduce the rate of oxidation of the metal by CO and especially $CO_2$.

In accordance with various aspects of the disclosure, operational parameters of recovery system 104, and particularly of deposition region 212 within housing 202 are controlled to obtain a desired supersaturation ratio to avoid homogeneous and/or heterogeneous dendritic growth of material, which can be conducive to formation of carbon dioxide via Boudouard reaction ($C+CO_2 \leftrightarrow 2CO$) and/or can be conducive to (re-)oxidation of the deposited and/or depositing material. By way of examples, a temperature of deposition region 212 can be controlled using heaters 230 and/or cooling jackets to obtain a desired supersaturation ratio. In the presence of potentially oxidizing gases, such as CO and $CO_2$, the favorable temperature of deposition may be much lower to inhibit oxidation of the material as the material initially deposits, so as to reduce deposited material reactivity, especially as the reactivity relates to the formation of $CO_2$ via the Boudouard reaction on the surface of the deposited material.

A desired temperature of deposition region 212 can depend on the material to be deposited. Hot gas flowing over media cools from temperatures that facilitate a gaseous state of the material to temperatures that allow the material to form into a solid. Subsequent removal of deposited material from housing 202 can be employed in order to reduce residence time.

In accordance with various embodiments of the disclosure, deposition occurs at a temperature near and below a melting temperature of the material. For example, the temperature can be maintained at between below the melting temperature to about 200° C. below the melting temperature, or below the melting temperature to about 100° C. below the melting temperature, or about 10° C. to about 500° C., about 50° C. to about 300° C., about 50° C. to about 225° C., or about 100° C. to about 200° C. below the melting temperature of the material to be deposited. In the case of Mg, for example, which has a melting temperature of about 650° C., the temperature of deposition region 212 can be between about 450° C. and about 550° C., for the operating pressures noted herein.

In accordance with further aspects of the disclosure, a supersaturation ratio of the material to be deposited can be maintained at a relatively low value—for example, from greater than 1 and less than 10,000, greater than 1 and less than 5,000, greater than 1 and less than 1,000, greater than 1 and less than 500, greater than 1 to about 50, greater than 1 to about 10, or greater than 1 to about 5. As a general principle, for a given partial pressure of material (e.g., metal) vapor, lower temperatures result in higher supersaturation ratios and higher temperatures result in lower supersaturation ratios. It is noted that the supersaturation temperature can vary along a flow of the entrant gas and/or moving bed. However, the supersaturation ratio within deposition region 212 desirably stays within the ranges noted herein.

Recovery system 104 can operate in a manner such that dense-packed crystalline material structures form on the media, as opposed to fine, loose-packed, specular, or dendritic crystal structures that are known to occur at low deposition temperatures and high supersaturation ratios (e.g., greater than 1,000), especially as in the case of homogeneous nucleation where fine magnesium particles may become pyrophoric.

Another controllable parameter includes a rate of material removal from first outlet 208. A residence time can be adjusted to obtain desired material quality, to mitigate undesired reactions, and/or to control a temperature of the moving bed of particles 225. In accordance with various examples of the disclosure, a residence time of gas including material to be deposited is less than a minute.

Recovery system 104 can be operated in a continuous or semi-continuous mode, such that particles 224 are continuously fed or semi-continuously fed to deposition region 212. Similarly, product can be collected from deposition region 212 in vessel 216—e.g., using a suitable valve and/or auger 238 to collect deposited material in a continuous or semi-continuous manner.

In the illustrated example, non-deposited, byproduct gases flow out of housing 202 through outlet 210 that is not common to the port where collected deposited material is removed. The byproduct gases can be filtered using a filter 236 before vacuum source 222 and/or optionally an analyzer 242 (e.g., a NDIR/O2 analyzer).

Variations of the illustrated systems and methods are also contemplated by this disclosure. For example, although illustrated in a counter-current configuration, other flow configuration can be employed, such as co-current flow of gases and media (or other directed flow arrangements), where at some point in the system the two streams diverge in order to provide a means of separation either as a function of the device itself or after deposition and cooling has taken place. Similarly, the illustrated tubular design may be preferred due to its operational simplicity; however, the geometry of the system is not confined by the tubular design. In the methods described herein, active heating is employed because hot gases may not carry significant quantities of sensible heat and are extremely susceptible to cooling upon encountering cool surfaces; however some systems can additionally or alternatively include a mechanism, such as cooling jackets, to remove heat in order to control temperatures, and therefore also control supersaturation ratios and the profile of the system.

Methods and systems have been described above with reference to a number of exemplary embodiments and examples. It should be appreciated that the particular embodiments shown and described herein are illustrative of the invention and its best mode and are not intended to limit in any way the scope of the invention as set forth in the claims. It will be recognized that changes and modifications may be made to the exemplary embodiments without departing from the scope of the present invention. These and other changes or modifications are intended to be included within the scope of the present invention, as expressed in the following claims.

We claim:

1. A recovery system comprising:

a housing having an interior volume, a first end and a second end opposite the first end, the housing comprising:

a first inlet at the first end for receiving a supply of moving bed particles into the interior volume, the moving bed particles being solid at the first inlet;

a second inlet for receiving gas-phase material comprising a metal to be condensed or deposited into the interior volume;

a first outlet at the second end for dispensing the supply of moving bed particles having the metal condensed or deposited thereon from the interior volume, at least some of the moving bed particles being non-solid at the first outlet; and a second outlet for dispensing gas and capturing a fraction of liquid or volatilized matter from the non-solid moving bed particles and other byproducts from the interior volume; and a condensation or deposition region between the first inlet and the first outlet for condensing or depositing the metal onto the moving bed particles and where the moving bed particles undergo a phase change from solid;

a temperature controller operably coupled to the interior volume of the housing to maintain temperature of the particles in the interior volume 50° C. to 300° C. below a boiling point of the metal if condensing the metal and 50° C. to 300° C. below a melting point of the metal if depositing the metal;

a collection vessel operably connected to the first outlet; and a gas collection system in-line with the second outlet, the gas collection system including a vacuum source operably connected to the second outlet to maintain a partial pressure of any reactive gas in the interior volume to less than 10,000 pascals.

2. The recovery system of claim 1, wherein the vacuum source is configured to maintain the partial pressure of any reactive gas within the interior volume to less than 5,000 pascals.

3. The recovery system of claim 1, wherein the second inlet is configured to receive gas-phase material comprising one or more metals selected from the group of Zn, Mg, Mn, Sn, Al, Ca, Sb, Na, Bi, Be, Ti, Hf, Zr, Si, and Ge.

4. The recovery system of claim 1, wherein the vacuum source is configured to maintain a supersaturation ratio for the metal in the interior volume of about 1 to about 500.

5. The recovery system of claim 1, wherein the vacuum source is configured to maintain a supersaturation ratio for the metal in the interior volume of about 1 to about 50.

6. The recovery system of claim 1, wherein the vacuum source is configured to maintain a supersaturation ratio for the metal in the interior volume of about 1 to about 5.

7. The recovery system of claim 1, having an operating pressure from about 100 pascals to about 100,000 pascals.

8. The recovery system of claim 1, wherein the second inlet is at the first end of the housing and the second outlet is at the second end of the housing, providing co-current flow for the moving bed particles and the gas-phase material.

9. The recovery system of claim 1, wherein the second inlet is at the second end of the housing and the second outlet is at the first end of the housing, providing counter-current flow for the moving bed particles and the gas-phase material.

10. The recovery system of claim 1, further comprising a heat source to heat the supply of moving bed particles.

11. A recovery system comprising:

a housing comprising:

a first inlet for receiving a supply of solid moving bed particles having an average cross-sectional length ratio relative to a diameter of the housing of between about 3:1 and about 15:1;

a second inlet for receiving gas-phase material comprising a metal to be condensed or deposited;

a first outlet for dispensing the supply of moving bed particles having the metal condensed or deposited thereon, at least some of the moving bed particles being non-solid at the first outlet; and a second outlet for dispensing gas and other byproducts and capturing a fraction of liquid or volatilized matter from the non-solid moving bed particles; and a condensation or deposition region between the first inlet and the first outlet for condensing or depositing metal onto the moving bed particles and where the moving bed particles absorb heat from the gas-phase material and undergo a phase change from solid;

a temperature controller operably coupled to the housing to maintain temperature of the particles in the interior volume 50° C. to 300° C. below a boiling point of the metal if condensing the metal and 50° C. to 300° C. below a melting point of the metal if depositing the metal;

a collection vessel operably connected to the first outlet; and a gas collection system in-line with the second outlet, the gas collection system including a vacuum source, wherein solid moving bed particles flow in a first direction within the condensation or deposition region and the gas-phase material flows in a second direction within the condensation or deposition region.

12. The recovery system of claim 11, wherein:

the first inlet is at a first end of the housing, the second inlet is at a second end of the housing, the first outlet is at the second end of the housing, and the second outlet is at the first end of the housing.

13. The recovery system of claim 11, wherein the vacuum source is operably connected to the second outlet to maintain a partial pressure of any reactive gas in the housing to less than 10,000 pascals.

14. The recovery system of claim 11, wherein the vacuum source is configured to maintain the partial pressure of any reactive gas within the housing to less than 5,000 pascals.

15. The recovery system of claim 11, wherein the second inlet is configured to receive gas-phase material comprising one or more metals selected from the group of Zn, Mg, Mn, Sn, Al, Ca, Sb, Na, Bi, Be, Ti, Hf, Zr, Si, and Ge.

16. The recovery system of claim 11, wherein the vacuum source is configured to maintain a supersaturation ratio for the metal in the interior volume of about 1 to about 500.

17. The recovery system of claim 11, wherein the vacuum source is configured to maintain a supersaturation ratio for the metal in the interior volume of about 1 to about 50.

18. The recovery system of claim 11, further comprising a heat source to heat the supply of moving bed particles.

19. The recovery system of claim 1, wherein the moving bed particles have an average cross-sectional length ratio relative to a diameter of the housing of between about 3:1 to about 15:1.

* * * * *